US006893409B1

(12) United States Patent
Lina

(10) Patent No.: US 6,893,409 B1
(45) Date of Patent: May 17, 2005

(54) FOOT MOUNTED VENOUS COMPRESSION DEVICE

(75) Inventor: Cesar Z. Lina, Universal City, TX (US)

(73) Assignee: KCI Licensing, Inc., San Antonio, TX (US)

( * ) Notice: Subject to any disclaimer, the term of this patent is extended or adjusted under 35 U.S.C. 154(b) by 0 days.

(21) Appl. No.: 09/432,904

(22) Filed: Nov. 2, 1999

Related U.S. Application Data

(63) Continuation of application No. 08/816,807, filed on Mar. 19, 1997, now Pat. No. 5,989,204, which is a continuation of application No. 08/428,268, filed on Apr. 25, 1995, now abandoned, which is a continuation of application No. 08/275,920, filed on Jul. 14, 1994, now abandoned, which is a continuation of application No. 08/000,545, filed on Jan. 4, 1993, now abandoned, which is a continuation of application No. 07/766,576, filed on Sep. 27, 1991, now abandoned.

(51) Int. Cl.[7] ..... A61H 23/04
(52) U.S. Cl. ..... 601/152; 128/DIG. 20
(58) Field of Search ..... 601/41, 44, 148–152; 128/DIG. 20; 602/13

(56) References Cited

U.S. PATENT DOCUMENTS

| | | | | |
|---|---|---|---|---|
| 1,492,514 A | | 4/1924 | Jensen | |
| 2,708,930 A | * | 5/1955 | Lowman | |
| 2,880,721 A | | 4/1959 | Corcoran | |
| 3,773,036 A | | 11/1973 | Weyer | |
| 4,033,337 A | | 7/1977 | Raczkowski | |
| 4,375,217 A | * | 3/1983 | Arkans | 601/152 |
| 4,614,180 A | | 9/1986 | Gardner et al. | |
| 4,696,289 A | | 9/1987 | Gardner et al. | |
| 4,920,971 A | * | 5/1990 | Blessinger | 600/492 |
| 4,941,458 A | | 7/1990 | Taheri | |
| 4,947,834 A | * | 8/1990 | Kartheus et al. | 601/152 |
| 4,971,044 A | | 11/1990 | Dye | |
| 5,052,128 A | | 10/1991 | Lonardo | 36/11.5 |
| 5,052,377 A | * | 10/1991 | Frajderrajch | 601/152 |
| 5,113,877 A | | 5/1992 | Johnson, Jr. et al. | |

FOREIGN PATENT DOCUMENTS

| | | |
|---|---|---|
| DE | 2390156 | 5/1977 |
| JP | 47-10392 | 10/1972 |
| JP | 48-20636 | 3/1973 |

OTHER PUBLICATIONS

Becket, C. et al., "The Venous Pump of the Foot,"*Nursing Times*, vol. 84, No. 19, pp. 45-47, 1988.
Dillon, R., "Treatment of Resistant Venous Stasis Ulcers and Dermatitis with the End-Diastolic Pneumatic Compression Boot", *Journal of Vascular Diseases*, pp. 47-55, Jan. 1986.

(Continued)

*Primary Examiner*—Danton DeMille

(57) ABSTRACT

A medical device having an expandable fluid-tight bladder formed integral within a wrap (or sheath) that can be securely fastened onto a human foot. The foot wrap positions and holds the bladder under the arch of the foot so as to compress the sole area when the bladder is inflated. The foot wrap is soft, lightweight, flexible and suitable for extended wear with minimum discomfort. It can be readily used with a pneumatic or hydraulic pressure applicator or cyclic pump to promote blood circulation in the legs of bedridden patients.

19 Claims, 2 Drawing Sheets

OTHER PUBLICATIONS

Gardner, A.M.N. et al., *The Return of Blood to the Heart: Venous Pumps in Health and Disease*, John Liberty & Company Ltd., 1989.

Gaskell, P. et al., "The Effect of a Mechanical Venous Pump on the Circulation of the Feet in the presence of Arterial Obstruction,"*Surgery, Gynecology & Obstetrics*, vol. 146, pp. 583-592, Apr. 1978.

Parrott, J.C.W., *The Effect of a Mechanical Venous Pump on the Circulation of the Feet in the presence of Arterial Obstruction*, Master'thesis, University of Manitoba, Department of Physiology, Oct. 1972.

Rastgeldi, S. Article in Two Parts: "I. Pressure Treatment of Peripheral Vascular Disease," and "II. Intermittent Pressure Treatment of Peripheral Vascular Disease, A Survey of Sixteen years Personal Experience," published in Opuscula Medica, Supplemetum XXVII 1972, Gundad av Sixten Kallner 1956.

* cited by examiner

FOOT MOUNTED VENOUS COMPRESSION DEVICE

RELATED APPLICATIONS

This application is a continuation of Applicant's U.S. patent application Ser. No. 08/816,807 filed Mar. 19, 1997 now U.S. Pat. No. 5,989,204, which is a continuation of U.S. patent application Ser. No. 08/428,268 filed Apr. 25, 1995, now abandoned, which is a continuation of U.S. patent application Ser. No. 08/275,920 filed Jul. 14, 1994, now abandoned, which is a continuation of U.S. patent application Ser. No. 08/000,545 filed Jan. 4, 1993, now abandoned, which is a continuation of U.S. patent application Ser. No. 07/766,576 filed Sep. 27, 1991, now abandoned. By this reference, the full disclosures, including the claims and drawings, of U.S. patent application Ser. No. 08/816,807, Ser. No. 08/428,268, Ser. No. 08/275,920, Ser. No. 08/000,545, and Ser. No. 07/766,576 are incorporated herein as though now set forth in their respective entireties.

BACKGROUND OF THE INVENTION

1. Field of the Invention

The present invention relates to massage devices which apply pressure to the body. More particularly, the invention is in the class of medical devices which utilize cyclic pressure to aid blood circulation in the limbs of a human body.

2. Related Art

Medical devices that apply cyclic pressure to a person's legs, arms and/or feet are very old and well-known in the art. Many have employed pulsating pads or plungers for improving circulation. Others have used hydraulic and pneumatic bladders for the same and for many other purposes. The shapes, sizes, and composition of such bladders and pads are widely varied, depending largely on their particular application.

Man has known the fundamental principle of most cyclic compression devices for thousands of years. They are merely a more recent embodiment of the old art of massage, which has been used to stimulate circulation since prehistory. Use of mechanical devices to effect the massaging action is obviously more recent, but has a clear history of more than 150 years.

Full understanding of the mechanism involved in this form of improving blood flow is more recent but has not fundamentally changed the devices used to accomplish this result. Veins are now known to contain a series of one-way check valves along their length. Thus, when pressure is applied, compressing a vein, the fluid expelled therefrom can only proceed in the direction of normal circulation. When such compression is relaxed, the vein returns to its normal circular cross-section, and the flow of blood into the vein is increased until it reaches its normal state of back pressure. Repeating this cycle in a cyclic fashion thus increases blood flow in the normal direction of circulation.

Such compression/decompression cycles occur naturally in humans as part of the action of the muscles and flexure of the limbs. It has been known for many years that the arch of the foot includes a large venous plexus (or group of veins). It is also known that this venous plexus is compressed during normal walking or running, thereby stimulating circulation. This efficient circulation aid is a marvelous design by our Creator, as its effect is greatest when the leg muscles (the largest muscles in the body) are in action and need the oxygen supplied by enhanced circulation.

For these and other reasons, the foot has long been known as an effective site for applying cyclic pressure. For instance, many devices such as Massator's "PediPulsor" improve circulation by positioning a pulsating, dome-shaped pad in the arch of the foot. Many others have targeted the arch of the foot with flexible pneumatic chambers. A partial sampling of such pneumatic devices that target the arch of the foot includes Japanese utility model No. 47-10392, U.S. Pat. No. 4,614,180 issued to Gardner et al. and U.S. Pat. No. 4,941,458 issued to Taheri.

Many others have long recognized that the foot contains veins that can be massaged or pumped to provide better circulation. Some examples are: L. E. Corcoran, who states in his U.S. Pat. No. 2,880,721 issued Apr. 7, 1959 that massaging the soles of the feet "promotes a beneficial degree of circulation;" Richard Dillon, M.D., whose *Journal of Vascular Diseases*, January 1986 report entitled "Treatment of Resistant Venous Stasis Ulcers and Dermatitis with the End-Diastolic Pneumatic Compression Boot" on treatment of circulation-impaired patients states "compression boot therapy enjoys a 173 year history;" and P. Gaskell, M.D. and J. C. W. Parrot, M.D., whose *Surgery, Gynecology and Obstetrics*, April 1978 report entitled "The Effect of Mechanical Venous Pump on the Circulation of the Feet in the Presence of Arterial Obstruction" shows a high level of understanding of the process of venous pumping with pulsed air by stating "[w]e have found that the boot covering the foot alone is simpler, less cumbersome, and gives a greater reduction of venous pressure than either a large cuff which covers the whole calf or a boot which includes the calf and the foot."

SUMMARY OF THE INVENTION

The present invention is directed toward improving upon the teachings of the prior art, uniquely integrating various concepts and features to provide a significant advancement in the field. A primary object of the invention is to provide a small, lightweight and comfortable device, preferably suitable for prolonged wear, which helps prevent and/or solve many of the problems associated with impaired circulation.

Another object includes providing a pneumatic device which encloses only limited portions of the foot, especially those portions which may be readily compressed to improve circulation. Related objects include providing comfort and moisture control and avoiding the need for accessories such as additional stockings, wraps, sandals, straps, and the like, which have been required by the prior art.

Another object of the present invention is to provide an intermittent compression device requiring a minimum volume of air per pulsation.

Another object is to provide a blood circulation aid which will fit a wide variety of patients without requiring any modification or adjustments.

Another object is to provide a device of great simplicity and ease-of-use in contrast to other devices designed for the purpose of aiding blood flow in the feet and legs.

Another object of the invention is to provide a blood flow improvement device which, due to its inherent low manufacturing cost, is practical to use as a disposable item rather than cleaning and reusing.

The present invention addresses the foregoing and many other objects by providing an ingenious article that integrates a compression bladder and its entire mounting, stabilizing and adjustment systems into a simple and economical construction.

The present invention comprises a foot wrap device made from two sheets of fabric sewn or welded together to form an inflatable pocket or bladder in part of the main body area. One aspect of the invention relates to its roughly T-shaped configuration, with at least one extension from the main body area for encompassing the foot's arch. A second extension preferably extends from the main body in a direction opposite the first. A third extension from the main body is roughly perpendicular to the arch-encompassing extensions, for embracing the back of the heel. In the preferred embodiment, both inner and outer fabric layers are cut from the same pattern.

Fasteners formed integral with two of the extensions enable releasable application on the foot. Preferably, such fasteners include trademark "VELCRO" hook connectors, and the outer surface of the foot wrap is formed of trademark "VELCRO" loop material (or the equivalent) for mating with the hooked fasteners. The inner layer of the foot wrap is a vapor permeable material having greater elasticity than the outer layer. Both fabrics are preferably impermeable to air and capable of being fused together by heat welding. A filling tube is sealed into said inflatable bladder through the outer fabric layer.

In the preferred embodiment, the complete foot wrap weighs only a few ounces and is soft and pliable. When the device is properly applied, the inflatable bladder lies under the arch of the foot. One extension wraps over the instep to completely surround the foot and fastens to the outside surface of the main body section. The second extension wraps around behind the heel and also fastens to the outside surface of the main body section, thus securely holding the device in place on the foot to hold the bladder in place when it is inflated. Fluid for such extension is supplied in a pulsed sequence selected for frequency and intensity by the physician from one of the pump/control systems well known in the art.

Numerous other features, advantages, and objects of the invention will evident from the following more detailed description of certain preferred embodiments, particularly when considered together with the accompanying drawings and appended claims.

DETAILED DESCRIPTION OF THE PREFERRED EMBODIMENT

Figure 1:
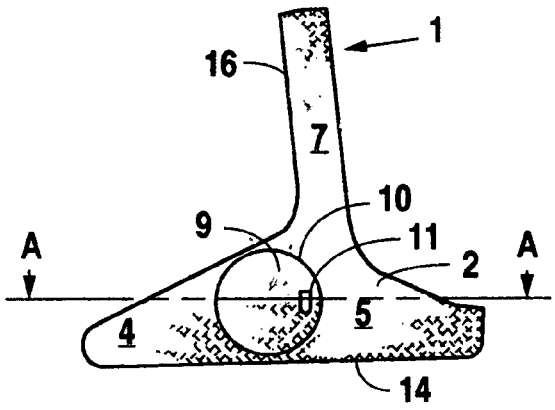
FIG. 1 shows a first embodiment of the present invention in the form of a foot wrap 1, particularly showing the outer surface of the foot wrap as it is laid out flat.
Figure 2:
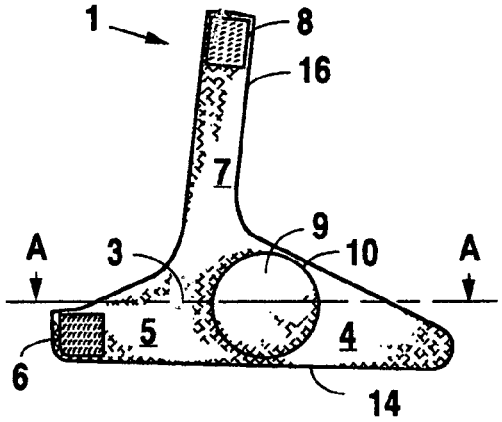
FIG. 2 shows a view of the inner surface of the foot wrap 1 laid flat.
Figure 3:
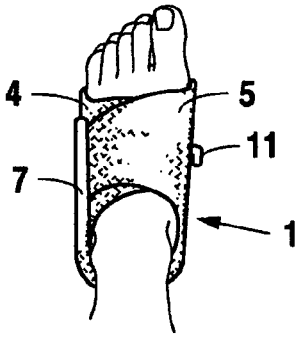
FIG. 3 shows a top view of the foot wrap 1 in place on a human foot.
Figure 4:
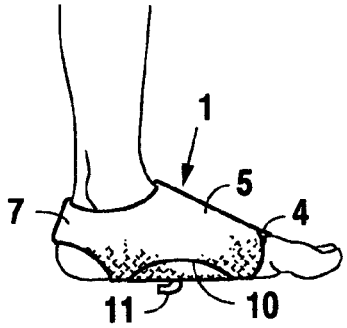
FIG. 4 shows a side view of the foot wrap 1 in place on a human foot.
Figure 5:
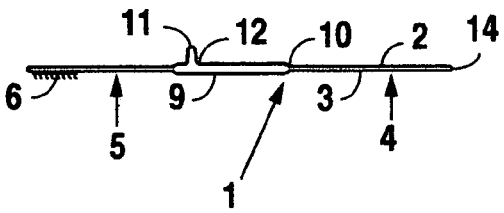
FIG. 5 shows a cross section of the foot wrap 1 sectioned along plane "A—A" shown in FIG. 2.

Referring to FIGS. 1–6, a first embodiment of the present invention is shown in the form of foot wrap 1. In FIG. 1, foot wrap 1 is shown open (i.e., laid out flat), with the outer surface of foot wrap 1 facing the viewer. FIG. 2 is a view from the opposite side showing the inner surface of foot wrap 1. FIG. 5 is a cross section along line "A—A" of FIG. 2 and generally illustrates the construction of the foot wrap. The foot wrap 1 is generally formed of two sheets 2 and 3 which are bonded together to form a bladder 9 with tabs 4, 5 and 7 extending away from the bladder 9. Foot wrap 1 also includes a fluid inlet 11 (also referred to as "fitting 11") for inflating and deflating the bladder 9, as well as fasteners 6 and 8 for releasably securing the wrap 1 on a foot (designated as foot 100 in the drawings). To the extent any of these basic components are not otherwise readily available through numerous manufacturers, they can be obtained or located through Kinetic Concepts, Inc. in San Antonio, Tex.

Referring primarily to FIG. 5, sheet 2 is preferably cut from a robust, non-stretch fabric. The outer surface of sheet 2 (i.e., the surface facing away from sheet 3) has loops like those found on trademark "VELCRO" loop material, which are compatible to releasably engage trademark "VELCRO" hook material. The interior surface of sheet 2 (i.e., the surface facing toward sheet 3) is heat-weldable. Sheet 2, thus, is referred to as a sheet of laminated loop fabric that forms the outer sheet of wrap 1.

Preferably, although each of the sheets 2 and 3 are air impermeable, they are each also formed of vapor permeable fabric. Their vapor-permeability serves to enable moisture from foot 100 to evaporate despite the foot wrap 1. This is especially preferable for sheet 3 so that perspiration adjacent bladder 9 can be evacuated from the site by the fluid that inflates and deflates bladder 9. The removal of surface moisture forming on the patient's skin beneath the foot wrap is beneficial since it helps promote the maintenance and healing of skin conditions, especially during protracted use.

Figure 6:
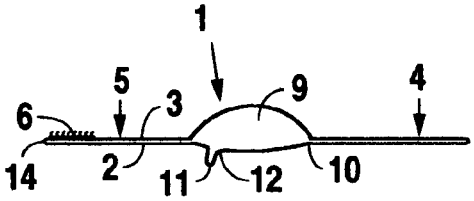
FIG. 6 shows the same cross section as in FIG. 5, except that bladder 9 is shown inflated in FIG. 6.
Figure 7:
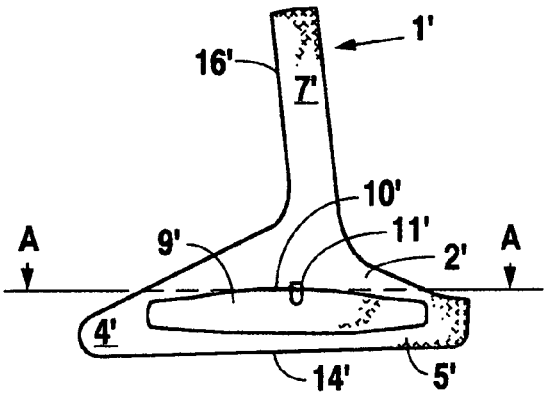
FIG. 7 shows a second embodiment of the present invention in the form of a foot wrap 1', laid out flat in the same manner as foot wrap 1 in FIG. 1.
Figure 8:
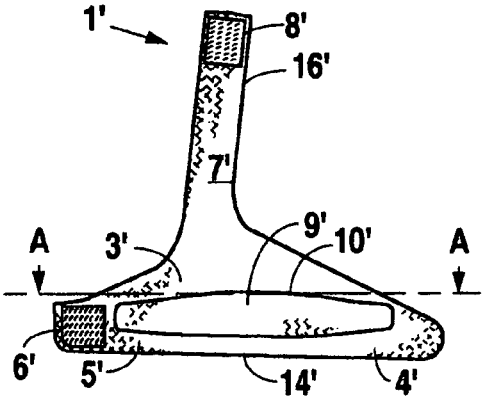
FIG. 8 shows a view of the inner surface of the foot wrap 1' laid flat.
Figure 9:
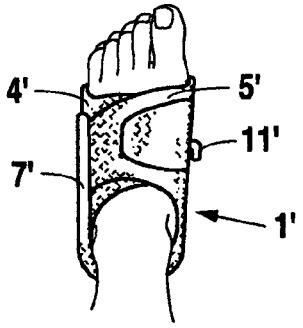
FIG. 9 shows a top view of the foot wrap 1' in place on a human foot.
Figure 10:
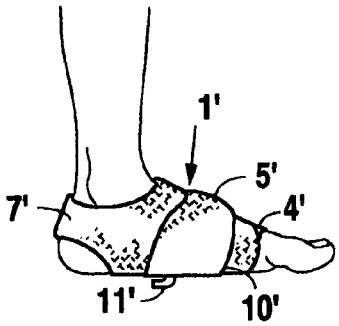
FIG. 10 shows a side view of the foot wrap 1' in place on a human foot.

Sheet 3 is preferably cut from the same or a similar pattern as sheet 2, so that it matches neatly with sheet 2. The manufacturing process may be simplified by first joining the sheets 2 and 3 together (as described elsewhere herein) and then cutting the border of each sheet. The cutting process may also be simplified by welding the two sheets together while simultaneously heat-cutting the border of the fabric with the same die (as is common in the art), although this process is not always successful due to the compositions of the sheets. Sheet 3 is preferably also a semi-elastic fabric, so that it expands more than outer sheet 2 when bladder 9 is inflated (as shown in FIG. 6). The inner surface of sheet 3 (i.e., the surface facing toward sheet 2) is heat-weldable to enable bonding with the inner surface of sheet 2. It is important that the outer surface of sheet 3 (i.e., the surface facing away from sheet 2) is soft and comfortable against the skin, as that surface is likely to be in contact with the patient's skin during use. In the preferred embodiment, sheet 3 is a laminated trademark "LYCRA" material that meets the foregoing characteristics. As will be evident from this description to those of the ordinary skill in the art, other fabrics such as less costly nylon fabrics may be substituted with related sacrifices of various aspects of this invention.

Bladder 9 is formed between sheet 2 and sheet 3 by weld line 10. Weld line 10 is a closed line so that it completely surrounds and thereby defines a closed area on each of sheets 2 and 3. Thus, bladder 9 is a sealed bladder, the only inlet or outlet of which is provided by a tubular connector fitting 11 (described below). Bladder 9 is provided in foot wrap 1 to apply pressure on the foot 100 when the wrap 1 is secured on the foot 100 and the bladder is inflated. Bladder 9 is of minimum size and volume consistent with its object of exerting pumping pressure on the foot and therefore requires a minimum volume of pressurized air per pulse. It is seen that although the bladder 9 occupies only the sole area of the foot 100, pressure and bladder expansion there causes the fabric enclosure around the foot to tighten and exert a compression force all around the arch region 101 of the foot 100. Bladder 1 is primarily intended for pneumatic inflation, although other fluids could be substituted by those of ordinary skill in the art.

In the first embodiment, bladder 1 is circular, roughly 3 to 5 inches in diameter. However, other shapes of bladders may be substituted while still employing many of the basic aspects of the invention. For instance, referring to a second embodiment as shown in FIGS. 7–10, an elongate bladder can be provided in an orientation that encircles the arch region 101 of the foot 100 when it is properly applied. The elongate bladder 9' of the second embodiment is slightly tapered (or may be pointed) near its opposite ends. The length of bladder 9' is sufficient such that its opposite ends will overlap each other when the wrap 1' is applied to a foot 100 of ordinary adult size. Other features of the second embodiment are substantially identical to like-numbered features of the first embodiment, and the corresponding descriptions of the first embodiment should be equally applicable to the second embodiment.

Referring again to the first embodiment, especially as shown in FIGS. 5 and 6, fitting 11 is a tubular fluid connector having an elbow form to reduce its height profile. Its elbow shape also enables connection of a fluid hose (not shown) to the fitting 11 and helps minimize the possibility of kinking such a hose during use. Conventional hose connectors may be incorporated in the outermost end of fitting 11 to enable connection of such a hose, although a properly sized hose can also be connected merely by a friction fit with fitting 11. Fitting 11 is formed of a compatible heat-weldable material and has a base flange 12. This fitting is inserted through a hole punched in fabric sheet 2 so that flange 12 contacts the heat-weldable inner surface of fabric sheet 2 and is then welded fluid-tight to complete the bladder.

As mentioned, bladder 9 is formed in a main portion of foot wrap 1, and tabs (or "extensions") 4, 5 and 7 extend generally away from the bladder 9. Tab 5 and a larger and longer extension 4 lie on opposite sides of the main portion that includes bladder 9, extending along the line "A—A." Extension or tab 7 lies substantially perpendicular to line "A—A" and is considerably longer and narrower than tab 5. In other preferred embodiments (not shown), the tab 7 is more perpendicular than pictured in any of FIGS. 1–10. Edge 16 of tab 7 as shown in FIG. 1 is aligned approximately tangent to the right hand (right in FIG. 1) extremity of bladder 9. Hook patch 6 is sewn or welded at or near the distal end of tab 5 and is located, as shown in FIG. 2, on the outer surface of inner sheet 3. The distal end of tab 7 is covered by a trademark "VELCRO" patch 8 in the same manner as tab 5 is covered with patch 6.

The outer perimeter 14 of the entire foot wrap 1 is RF-welded to form a single composite sheet with the single tubular fitting 11 mounted therein. This preferred embodiment weights less than 6 ounces and is approximately 38 centimeters in the direction of line "A—A" of FIG. 1 by 39½ centimeters in the perpendicular direction, which is in striking contrast to the large and complex foot wraps heretofore employed for this service. Other forms of connecting the sheets may be used, such as by stitching, although commensurate sacrifices of inventive aspects will be associated with such a change.

Foot wrap 1 also stands out for its ease and simplicity of use. Place the foot wrap in the flat position shown in FIG. 2, inner sheet 3 in contact with the foot, heel parallel to tab 7 and extending in the same direction as tab 7, wrap tab 4 around the arch of the foot and then wrap tab 5 over tab 4 where they overlap above the arch. Adjust the tightness of the fit to the degree desired and press the tip of tab 5 onto the outer surface of tab 4. This will enclose the foot in a closed hoop of fabric. The relative length of tabs 4 and 5 are not fixed but must meet the requirement of overlapping sufficiently to form a secure fastening when wrapped around a foot. Thus, tab 4 may be shorter than tab 5, although the general proportion illustrated in FIGS. 1 and 2 are preferred. To maintain the positioning of the bladder just established, draw tab 7 around the back of the foot (or heel) and pull it snug. Hooked tip 8 is then pressed onto the outer surface of foot wrap 1 where it overlaps on the side of the foot. The foot wrap is now locked in position until the fastenings are peeled open for removal of the foot wrap. This procedure can be accomplished in a few seconds, and removal requires only pulling of the two tabs 5 and 7.

Position of the bladder 9 relative to the sole of the foot is easily seen and minor adjustments, if required, consist of loosening and repositioning one or both tabs 5 and 7 as necessary.

The foot wrap 1 will fit a wide range of foot sizes without change in the application technique. Feet of very small persons may be fitted through the use of firm padding above the instep and behind the heel to simulate a larger foot while allowing the bladder to act directly against the sole of the foot, as desired.

The foot wrap may be manufactured in both right and left handed form, if desired, although it is also envisioned within the scope of this invention that a single foot wrap can be interchangeable for both left and right feet.

An additional feature of the small, light foot wrap is that air can enter between the foot and the foot wrap from both the front and rear areas where the foot wrap wraps onto the foot. During the deflated phase of pumping, the fit is quite loose and air can easily diffuse the approximately 3 inch distance required to completely cover the area of skin beneath said foot wrap.

The soft inner surface of foot wrap 1, which is also the outer surface of sheet 3, may be covered with a springy, open pile or other lining which promotes the entrance of air into the area between said foot wrap and the foot during the decompression phase. An alternative embodiment of the invention may use a non-vapor permeable sheet 3 having an outer surface with such air movement promoting characteristics.

This small, lightweight, inexpensive foot wrap fills an important need in modern medicine and fulfills all the objects set forth for the invention.

The foregoing preferred embodiments are but examples of the present invention. It should be noted that many modifications, variations, substitutions, equivalents, and alterations will be possible while still falling within the scope of this invention, as defined by the appended claims and as will be evident from the foregoing and following to those of ordinary skill in the art.

What is claimed is:

1. A medical device adapted for application of fluid pressure to a human foot comprising:

an interior elastic sheet for engaging a human foot; and an exterior fabric sheet joined with said interior sheet, the interior sheet and the exterior sheet together forming a foot wrap wherein:

said foot wrap encompasses an inflatable bladder within a region between and including the interior sheet and the exterior sheet, the inflatable bladder being disposed to apply pressure to the sole of a human foot;

said inflatable bladder comprises at least a portion of said interior sheet; and the elasticity of said interior sheet functioning to exert a lateral force on said exterior sheet such that said inflatable bladder is maintained substantially wrinkle-free when applied to a human foot.

2. A medical device adapted for application of fluid pressure to a human foot comprising:

an interior elastic sheet for engaging a human foot; and an exterior fabric sheet joined with said interior sheet, the interior sheet and the exterior sheet together forming a foot wrap wherein:

said foot wrap encompasses an inflatable bladder within a region between and including the interior sheet and the exterior sheet, the inflatable bladder being disposed to apply pressure to the sole of a human foot;

said inflatable bladder is formed between said interior sheet and said exterior sheet and comprises a portion of said interior sheet, a portion of said exterior sheet and an inlet for inflation thereof; and the elasticity of said interior sheet functioning to exert a lateral force on said exterior sheet such that said inflatable bladder is maintained substantially wrinkle-free when applied to a human foot.

3. The medical device as recited in claim 2, wherein said inlet comprises a tubular connector opening into said inflatable bladder for connecting said inflatable bladder with a source of pressurized fluid.

4. The medical device as recited in claim 2, wherein said portion of said interior sheet and said portion of said exterior sheet are perimetrically sealed to form said inflatable bladder.

5. The medical device as recited in claim 4, wherein said inflatable bladder is formed by heat-welding said interior sheet to said exterior sheet.

6. The medical device as recited in claim 2, wherein said interior sheet comprises a vapor permeable construction.

7. A medical device adapted for application of fluid pressure to a human foot comprising:

an interior elastic fabric sheet for engaging a human foot;

an exterior fabric sheet joined with said interior sheet in a manner forming a foot wrap having an integral bladder formed in a main portion of said foot wrap between said interior sheet and said exterior sheet;

a first tab ending from the main portion of said foot wrap for wrapping around the arch of a human foot and releasably securing said foot wrap to the human foot with the bladder formed in the main portion of said foot wrap positioned so as to act against the sole of the foot when inflated; and an elongate second tab extending from the main portion of said foot wrap for wrapping around the heel for maintaining the position of the bladder against the sole of the foot.

8. The medical device as recited in claim 7, wherein said second tab is generally perpendicular to said first tab when said foot wrap is laid flat.

9. The medical device as recited in claim 8, said medical device further comprising a third tab, said third tab being generally opposed to said first tab.

10. The medical device as recited in claim 9, wherein:

said exterior sheet consists essentially of a hook-type connector compatible base material;

said first tab comprises a releasable hook-type connector permanently attached to a distal end thereof, said first and third tabs having dimensions sufficient for said foot wrap to wrap around the arch of a human foot with the distal end of said first tab overlapping a distal end of said third tab; and said second tab comprises a second releasable hook-type connector permanently attached to a distal end thereof, said second tab having a length dimension sufficient for said foot wrap to wrap around the heel of a human foot with the distal end of said second tab overlapping said first tab when said first and third tabs are wrapped about the arch of a human foot.

11. The medical device as recited in claim 9, wherein:

said exterior sheet consists essentially of a loop-type connector compatible base material;

said third tab comprises a first releasable hook-type connector permanently attached to a distal end thereof, said first and third tabs having dimensions sufficient for said foot wrap to wrap around the arch of a human foot with the distal end of said third tab overlapping a distal end of said first tab; and said second tab comprises a second releasable hook-type connector permanently attached to a distal end thereof, said second tab having a length dimension sufficient for said foot wrap to wrap around the heel of a human foot with the distal end of said second tab overlapping said first tab when said first and third tabs are wrapped about the arch of a human foot.

12. A medical device adapted for cyclical application of fluid pressure to a human foot comprising:

a foot wrap for engaging a human foot, said foot wrap comprising an integral inflatable bladder and an outer surface comprising a base material compatible with the hooks of a hook and loop-type fastener, a first tab comprising a plurality of hooks of a hook and loop-type fastener appended to said foot wrap for wrapping around the arch of a human foot for releasably securing said foot wrap to the human foot with the bladder positioned so as to act directly against the sole of the foot when the hooks contact the outer surface of said foot wrap; and an elongate second tab comprising a plurality of hooks of a hook and loop-type fastener appended to said foot wrap for releasably wrapping around the heel and releasably securing to the outside surface of said foot wrap for maintaining a position of the bladder against the sole of the foot.

13. The medical device as recited in claim 12, wherein said second tab is generally perpendicular to said first tab when said foot wrap is laid flat.

14. The medical device as recited in claim 13, said medical device further comprising a third tab appended to said first wrap, said third tab being generally opposed to said first tab.

15. The medical device as recited in claim 14, wherein:

said first tab comprises a first releasable hook-type connector attached to a distal end thereof, said first and third tabs having dimensions sufficient for said foot wrap to wrap around the arch of a human foot with the distal end of said first tab overlapping a distal end of said third tab; and said second tab comprises a second releasable hook-type connector attached to a distal end thereof, said second tab having a length dimension sufficient for said foot wrap to wrap around the heel of a human foot with the distal end of said second tab overlapping said first tab when said first and third tabs are wrapped about the arch of a human foot.

16. A medical device for cyclical application of fluid pressure to a human foot comprising:

an interior elastic fabric sheet for engaging a human foot;

an exterior fabric sheet consisting essentially of a hook-type connector compatible base material, said exterior fabric sheet being less extensible than said interior fabric sheet, said exterior sheet being joined with said interior sheet in a manner forming a one-piece foot wrap having:

an integral inflatable bladder formed between said interior and exterior sheets;

a first tab for releasably securing said foot wrap to a human foot by wrapping around the arch;

an elongate second tab for wrapping around the heel, said second tab being generally perpendicular to said first tab when said foot wrap is laid flat;

a third tab generally opposed to said first tab; and a main portion positioned generally between said first, second, and third tabs;

a first releasable hook-type connector attached to a distal end of said first tab, said first and third tabs having dimensions sufficient for said foot wrap to wrap around the arch of a human foot with the distal end of the first tab overlapping a distal end of said third tab; and a second releasable hook-type connector attached to a distal end of said second tab, said second tab having a length dimension sufficient for said foot wrap to wrap around the heel of a human foot with the distal end of the second tab overlapping the main portion.

17. The medical device of claim 16, wherein the inner surface of said exterior sheet comprises a heat-weldable laminate and the inner surface of said interior sheet comprises a heat-weldable laminate, said exterior sheet being at least heat welded to said interior sheet to form said one-piece foot wrap.

18. The medical device as recited in claim 17, said medical device further comprising a tubular connector opening into said inflatable bladder for connecting said integral inflatable bladder with a source of pressurized fluid.

19. A medical device for cyclical application of fluid pressure to a human foot comprising:

an interior elastic air impermeable fabric sheet for engaging a human foot, an inner surface of the interior sheet comprising a heat-weldable laminate, an outer surface of the interior sheet comprising a springy, open pile inner surface;

an exterior fabric sheet consisting essentially of a base material that is compatible to releasably engage hook-type connector material, an inner surface of the exterior sheet comprising a heat-weldable laminate, the exterior sheet being less extensible than the interior sheet, the exterior sheet being heat welded to the interior sheet in a manner forming a one-piece foot wrap having:

an integral inflatable bladder formed between the inner surfaces of the interior and exterior sheets;

a main portion to engage the sole of a human foot;

a first extension from the main portion for releasably securing the foot wrap to a human foot by wrapping around the arch;

an elongate second extension from the main portion for releasably securing the foot wrap to a human foot by wrapping around the heel, the second extension being generally perpendicular to said first extension when the foot wrap is laid flat;

a third extension from the main portion generally opposed to the first extension, the first extension being larger and longer than the third extension; and a first releasable hook-type connector permanently attached to an inner surface of a distal end of the third extension, the first and third extensions having dimensions sufficient for the foot wrap to wrap completely around the arch of a human foot with the distal end of the third extension overlapping a distal end of the first extension;

a second releasable hook-type connector permanently attached to an inner surface of a distal end of the second extension, the second extension having a length dimension sufficient for the foot wrap to wrap completely around the heel of a human foot with the distal end of the second extension overlapping the first extension; and a tubular connector opening into the integral, inflatable bladder for connecting the integral inflatable bladder with a source of pressurized fluid.

* * * * *